US006205991B1

(12) United States Patent
Summers et al.

(10) Patent No.: US 6,205,991 B1
(45) Date of Patent: Mar. 27, 2001

(54) BOWSTRING RELEASE WITH ADJUSTABLE TRIGGER

(76) Inventors: Gregory E. Summers, 105 Overlink Dr., Lynchburg, VA (US) 24503; Randy V. Summers, 405 Woodland Dr.; Marc T. Rentz, 230 WoodHaven Ct., both of Madison Heights, VA (US) 24572

( * ) Notice: Subject to any disclaimer, the term of this patent is extended or adjusted under 35 U.S.C. 154(b) by 0 days.

(21) Appl. No.: 09/481,410

(22) Filed: Jan. 12, 2000

(51) Int. Cl.[7] ..... F41B 5/18
(52) U.S. Cl. ..... 124/35.2
(58) Field of Search ..... 124/35.2

(56) References Cited

U.S. PATENT DOCUMENTS

| | | | | |
|---|---|---|---|---|
| 3,028,852 | | 4/1962 | Sutton, Jr. . | |
| 3,072,115 | | 1/1963 | Johnson . | |
| 3,757,763 | | 9/1973 | Pinti et al. . | |
| 3,929,120 | | 12/1975 | Barner | 124/35.2 |
| 3,954,095 | | 5/1976 | Lewis | 124/35.2 |
| 4,509,497 | | 4/1985 | Garvison . | |
| 4,831,997 | * | 5/1989 | Greene | 124/35.2 |
| 4,981,128 | | 1/1991 | Garvison . | |
| 5,020,508 | | 6/1991 | Greene, Jr. | 124/35.2 |
| 5,170,771 | | 12/1992 | Peck | 124/35.2 |
| 5,357,939 | | 10/1994 | Tentler et al. | 124/35.2 |
| 5,595,167 | * | 1/1997 | Scott | 124/35.2 |
| 5,615,662 | | 4/1997 | Tentler et al. | 124/35.2 |
| 5,653,214 | | 8/1997 | Lynn | 124/35.2 |
| 5,680,851 | | 10/1997 | Summers | 124/35.2 |
| 5,685,286 | | 11/1997 | Summers | 124/35.2 |
| 5,857,452 | * | 1/1999 | Troncoso | 124/35.2 |
| 5,937,841 | | 8/1999 | Summers et al. | 124/35.2 |
| 5,937,842 | | 8/1999 | Summers et al. | 124/35.2 |

OTHER PUBLICATIONS

Tru–Fire Power Grip brochure, Tru–Fire Corporation.

* cited by examiner

*Primary Examiner*—John A. Ricci
(74) *Attorney, Agent, or Firm*—Nixon & Vanderhye P.C.

(57) ABSTRACT

A bowstring release includes a release body having a pair of jaws actuated by an adjustable trigger; and a wrist strap operatively connected to the release body by an elongated link threadably connected at one end to the release body and at an opposite end to the wrist strap. A connector extends between the link and the wrist strap, and is pivotally mounted to the wrist strap.

23 Claims, 6 Drawing Sheets

BOWSTRING RELEASE WITH ADJUSTABLE TRIGGER

TECHNICAL FIELD

This invention relates to bowstring release devices and, more specifically, to a bowstring release device with an adjustable trigger, and with a new and improved wrist strap connector.

BACKGROUND

Various release devices are utilized in archery to assist the archer in pulling a bowstring to a fully drawn position and then releasing the bowstring to fire the arrow. Many of these devices include mechanical grippers which engage the bowstring directly, or which engage nock elements mounted on the bowstring. Other devices use rope looped about the bowstring as the release mechanism.

It is also known to use wrist straps connected to the release devices to enhance control and accuracy of the release device. Examples of such wrist straps may be found in U.S. Pat. Nos. 5,020,508; 4,981,128; 4,791,908; and 4,509,497.

SUMMARY OF THE INVENTION

The present invention relates to an improved bowstring release device and wrist strap, including an adjustable trigger on the release, and a novel connector by which the release is connected to the wrist strap.

In the exemplary embodiment, a bowstring release device of the type disclosed in U.S. Pat. Nos. 5,680,851; 5,685,286; and 5,937,842 has been modified to incorporate an adjustable trigger which permits the trigger element itself to be oriented in four different positions relative to the trigger actuation lever extending into the release body. This allows the user to customize the release to provide a comfortable feel during the firing procedure. This is achieved by having the trigger element separable from the actuation lever and by providing a series of detents in the actuation lever for selective engagement with a tab on the trigger element. Once the trigger element is moved to the desired orientation, it can be tightened by means of a fastener such as a set screw or the like.

The release device is secured to the wrist strap by means of an extended rod threadably received at one end in the release body, and secured at its opposite end to a connector attached to an otherwise conventional wrist strap. The connector has a generally triangular orientation, with an elongated slot along the base of the triangle. At the apex or forward end of the triangle, there is a raised boss having a smooth but tapered bore therein which receives the threaded rod extending away from the bowstring release. The rod passes through the boss and is secured by a nut. Tapering of the bore allows greater freedom of movement of the release relative to the wrist strap. It will also be appreciated that by tightening the nut on the connecting screw at the connector may be tightened thus adjusting the draw length of the device.

The connector is secured to the wrist strap by means of a nylon web stitched onto the underlying wrist strap after the nylon web is passed through the slot in the connector. The nylon web is then also stitched adjacent the slot where the web is folded partially onto itself, thus permanently holding the connector in lace. With this arrangement, the connector as well as the release is pivotable through 180° from a straightforward position, to a position where the release is essentially folded back onto the user's wrist.

Accordingly, in its broader aspects, the present invention relates to a bowstring release comprising a release body having a pair of jaws actuated by a trigger, the trigger including a trigger actuator and a trigger lever adapted to seat in any one of plural predetermined positions relative to the trigger actuator to thereby enable adjustment of the trigger relative to the release body.

In another aspect, the invention relates to a bowstring release comprising a release body having a pair of jaws actuated by a trigger; and a wrist strap operatively connected to the release body by an elongated link threadably connected at one end to the release body and at an opposite end to the wrist strap, and including a connector between the link and the wrist strap, the connector pivotally mounted to the wrist strap.

In still another aspect, the invention relates to a bowstring release comprising a release body having a pair of jaws actuated by a trigger, the trigger including a trigger actuator and a trigger lever adapted to seat in any one of plural predetermined positions relative to the trigger actuator to thereby enable adjustment of the trigger relative to the release body; and a wrist strap operatively connected to the release body by an elongated link threadably connected at one end to the release body and at an opposite end to the wrist strap, and including a connector between the link and the wrist strap, the connector pivotally mounted to the wrist strap.

BEST MODE FOR CARRYING OUT THE INVENTION

Figure 1:
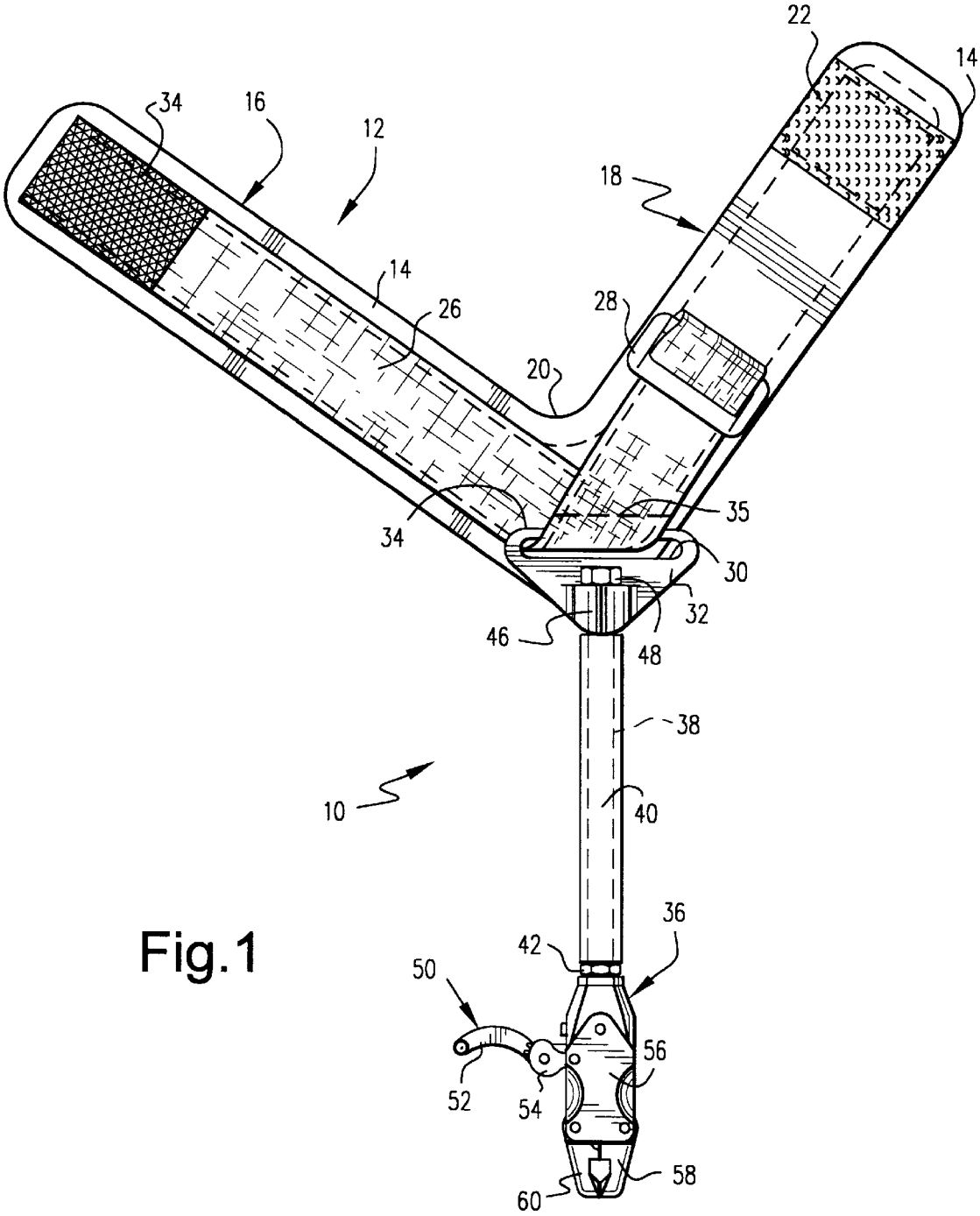
FIG. 1 is a side elevation of a bowstring release and wrist strap in accordance with this invention.

With initial reference to FIG. 1, the bowstring release and wrist strap assembly 10 includes a wrist strap 12, an underlying strap 14 of which is preferably made of leather or other suitable material, and formed in a generally V-shape, with legs 16, 18 extending angularly from an apex 20. The leg 18 of the wrist strap 12 includes a pad 22 of hook and loop type fastener material such as Velcro®. A second strap or web 26 of nylon or other suitable material is sewn or otherwise suitably secured to the underlying leather strap 12, with part of the strap and a buckle element 28 secured along the leg 18. Prior to stitching the nylon web 26 onto the strap 12, the overlying web 26 is passed through a slot 30 in a connector 32, from which it extends along the opposite leg 16 of the V-shaped strap 12, with a remote end of the strap 26 containing a second pad 34 of complementary type fastener material. Of course, the pad 34 could be directly attached to the underlying strap 14 if desired. The nylon web 26 is sewn to the underlying strap 14 along marginal edges of the web 26, and note also that the web 26 is stitched adjacent and parallel to the slot 30 of the connector 32, where the web 26 is partially folded over itself at the apex 20 of the wrist strap. This additional stitching is indicated by reference numeral 35, and provides an elongated through passage which receives the end wall 34 of the connector 32.

Figure 2:
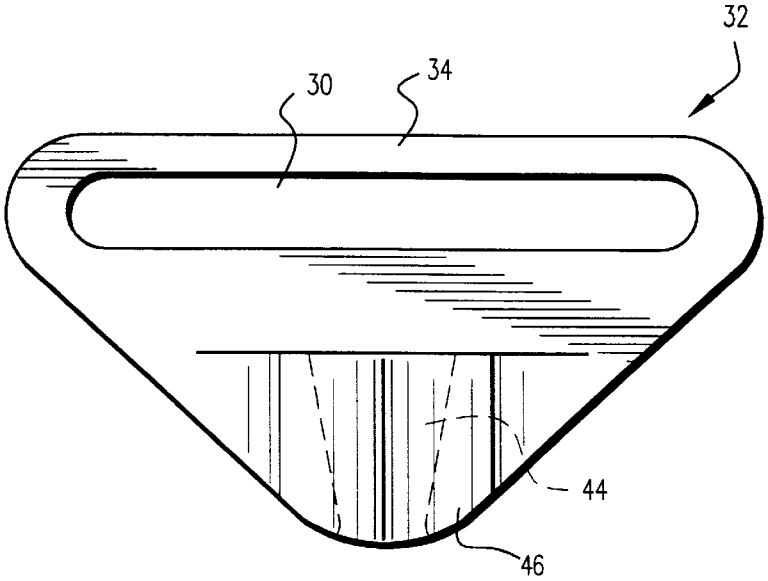
FIG. 2 is a side elevation of a wrist strap connector in accordance with the invention.
Figure 3:
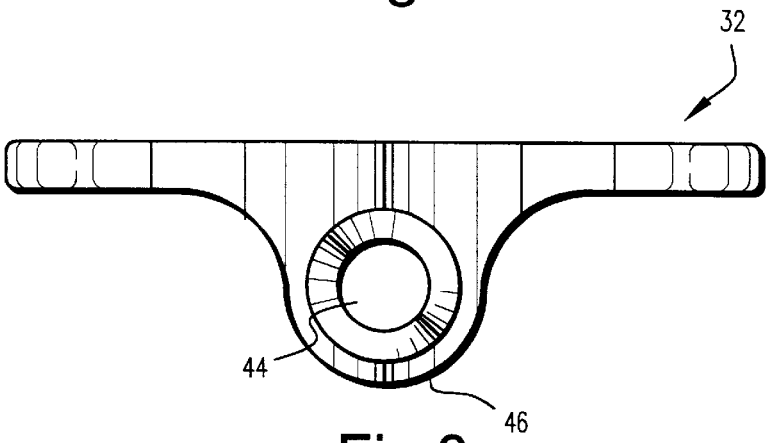
FIG. 3 is a front elevation of the connector shown in FIG. 2.
Figure 4:
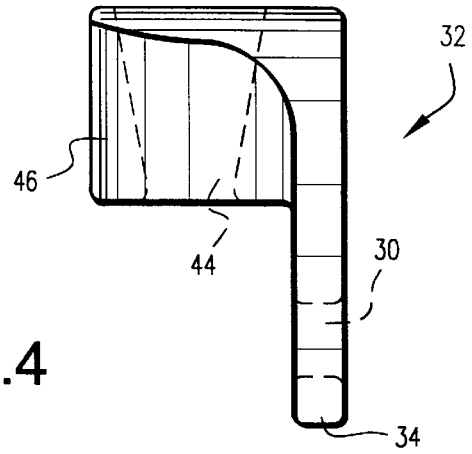
FIG. 4 is an end elevation of the connector shown in FIG. 2.
Figure 5:
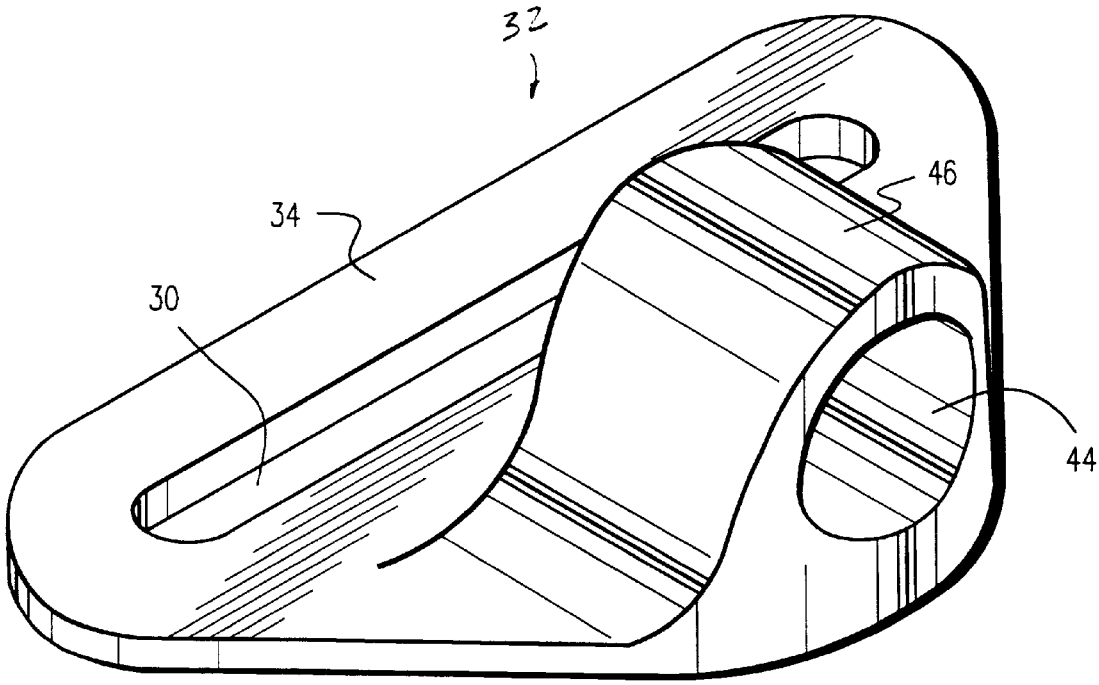
FIG. 5 is a perspective view of the connector shown in FIG. 2.

A bowstring release 36 is connected by a threaded rod or link 38 to the connector 32, with a rubber or plastic sleeve 40 slipped over the threaded rod. One end of the rod is threadably secured within the release 36 and locked in place by means of a nut 42. The opposite end of the threaded rod 38 passes through a smooth bore 44 in a raised substantially cylindrical bushing 46 formed at the forward edge of the connector 32. The bore 44 is best seen in FIGS. 2–4. A nut 48 is used to secure the threaded rod 38 relative to the connector. It will be appreciated that the draw length of the release can be adjusted by tightening or loosening the nut 48. Of course, the sleeve 40 will be sized to accommodate the normal range of adjustments. Note also that the bore 44 is tapered outwardly as it extends rearwardly toward the end wall 34. This arrangement provides great flexibility in that the release including the threaded extension rod 38 is not only free to pivot through a full 180° about the end wall 34, but the release 36 and extension rod 38 are also able to move essentially universally within the limits of the tapered bore 44.

Figure 6:
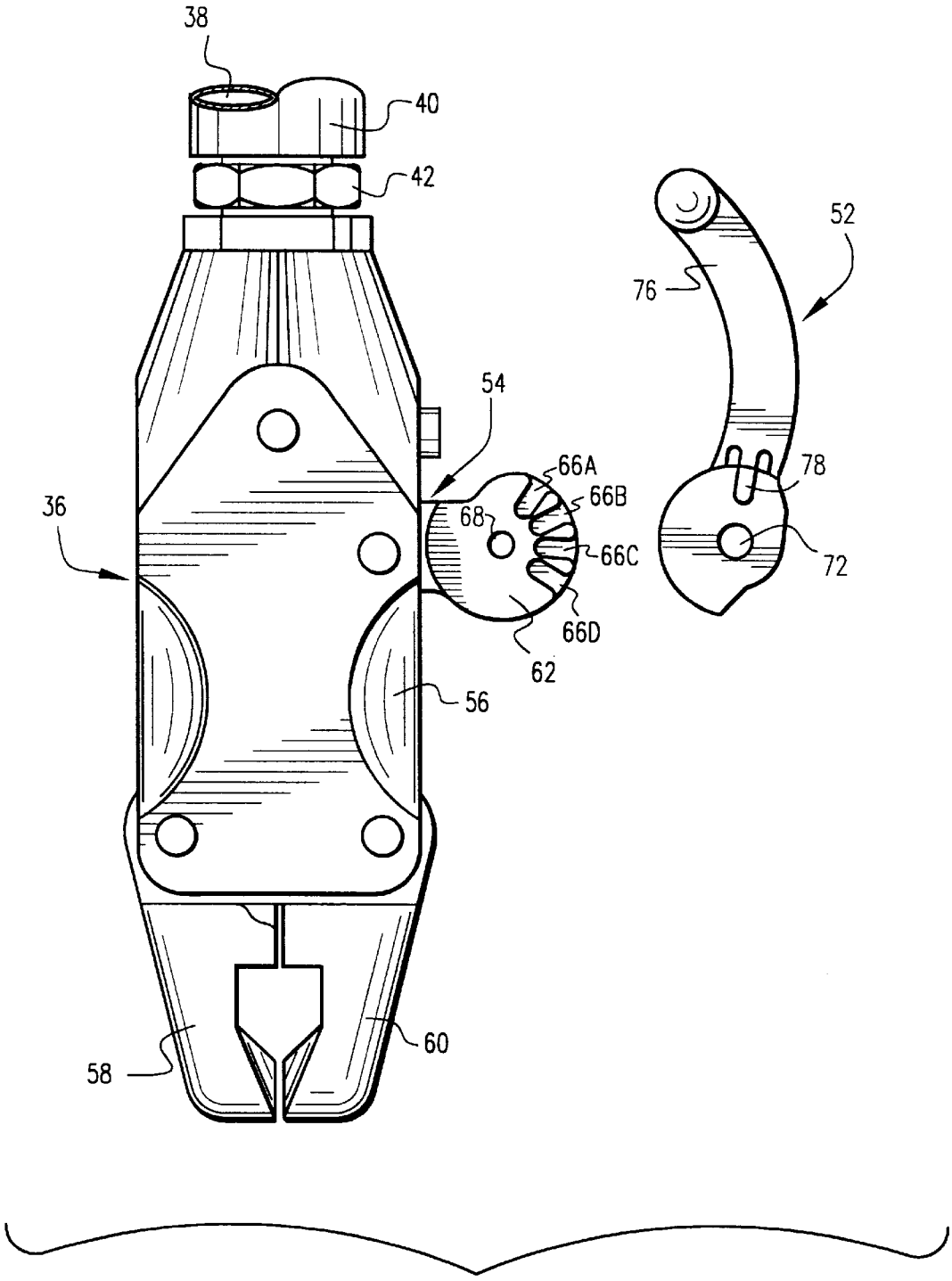
FIG. 6 is an enlarged partial side elevation, showing the trigger component separated from the trigger actuating lever.
Figure 7:
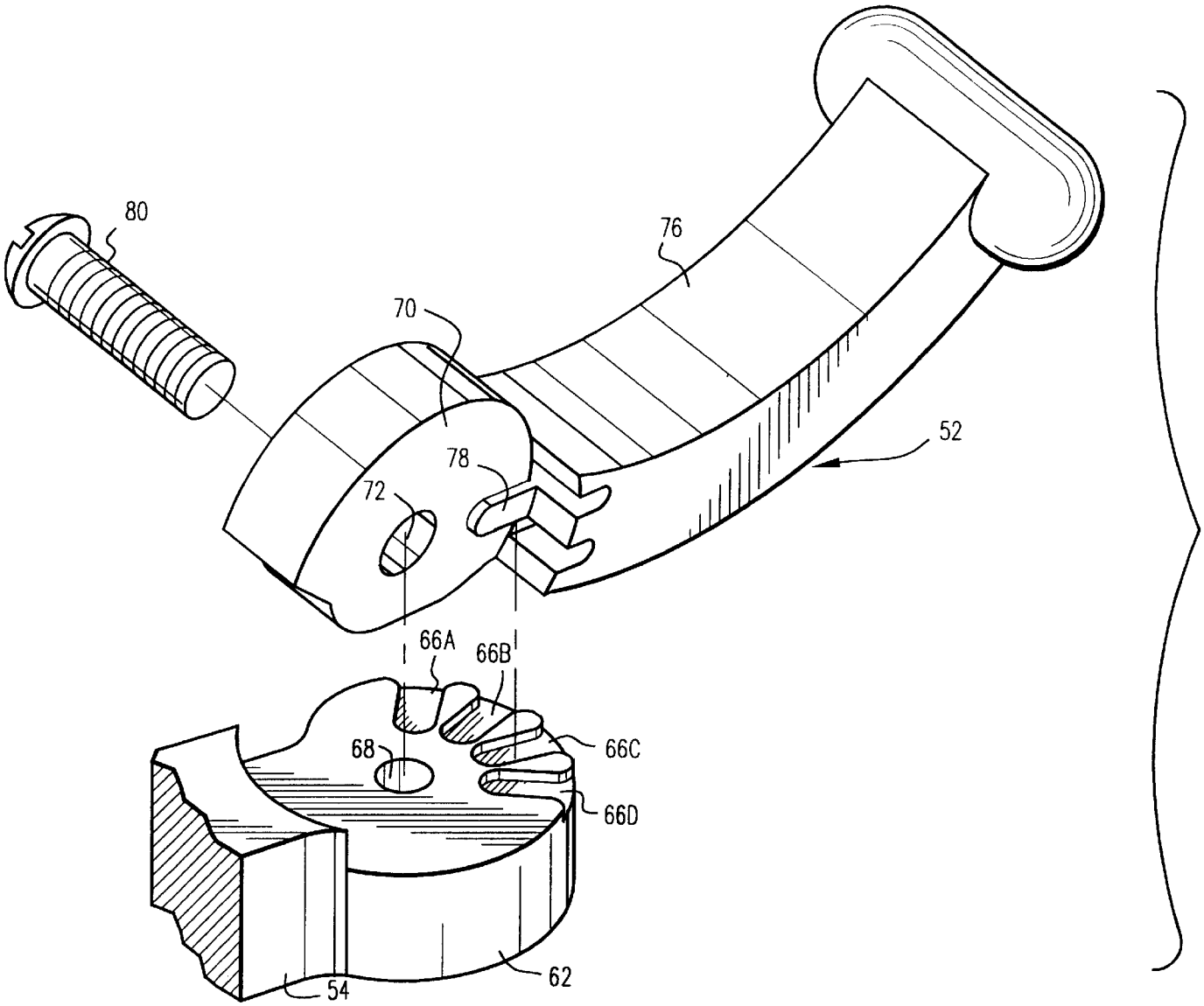
FIG. 7 is an exploded view illustrating the manner in which the trigger component is secured to the trigger actuating lever.
Figure 8:
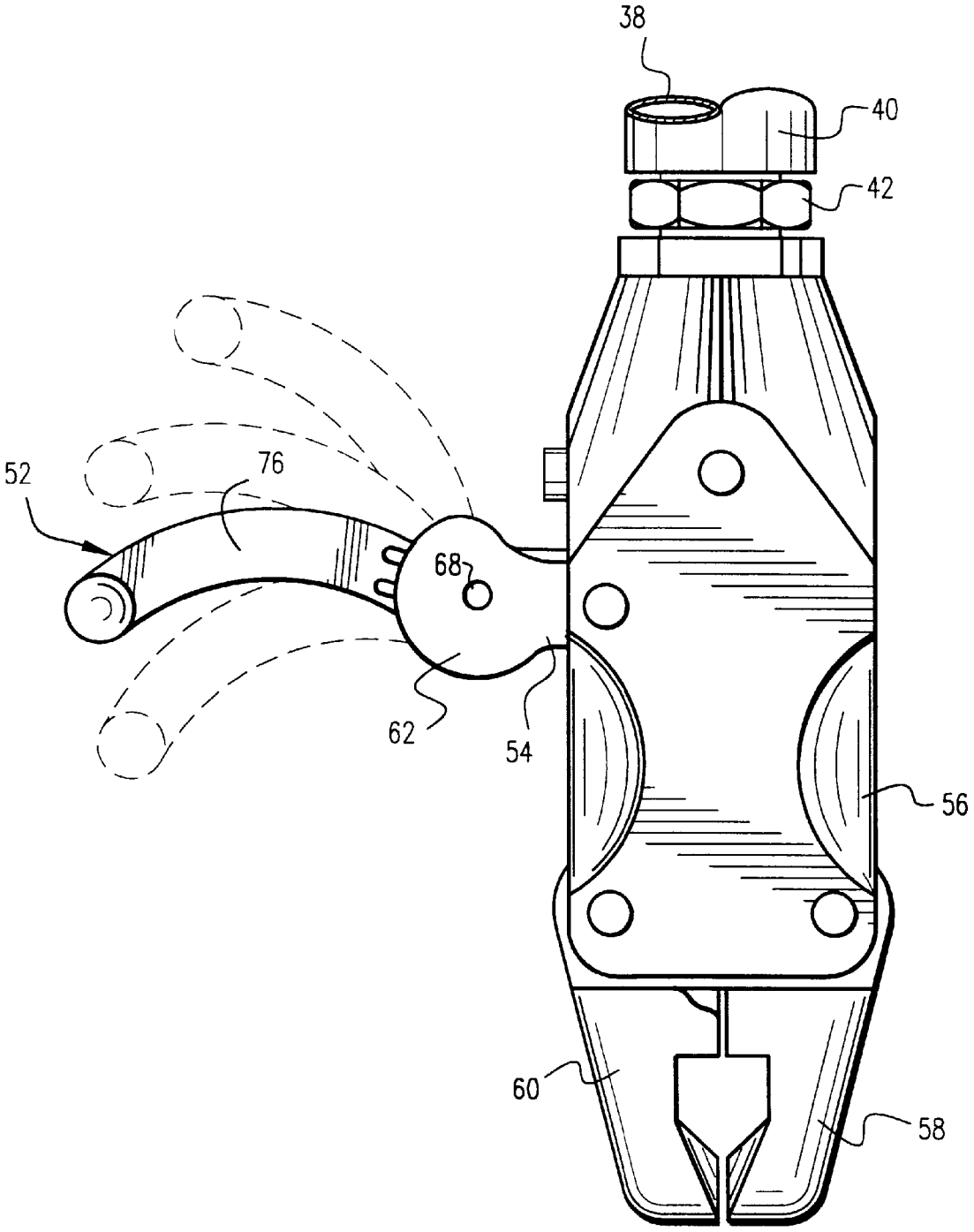
FIG. 8 is a partial side elevation illustrating the trigger component in different adjusted positions.

Returning to the release device 36 shown in FIG. 1, this is a fairly standard release, e.g., similar to releases disclosed in the '851 patent, although in accordance with this invention, the trigger 50 of the release 36 is adjustable as explained below in connection with FIGS. 6–8.

The trigger 50 includes a trigger lever 52 and a trigger actuator 54. The trigger actuator 54 extends out from the interior of the release body 56. The manner in which the actuator serves to open the jaws 58, 60 of the release is not part of this invention and therefore need not be described in detail. As earlier stated, the release may be similar to those disclosed in my above identified U.S. Patents.

The end of the trigger actuator 54 remote from the release body is formed with a generally circular pad 62, the upper surface of which is machined to include four peripheral recesses or notches 66 A, B, C and D, arranged in a generally radial configuration relative to a threaded center hole 68. The trigger lever 52 is formed with a part circular pad 70 and smooth bore center hole 72. At the periphery of pad 70 where the latter is joined to the finger engaging portion 76, a single radially inward tab or projection 78 is formed, that is sized and shaped to fit, selectively, in one of the notches 66 A–D. It will be appreciated that the trigger lever 52 can be adjusted relative to the trigger actuator 54 (and thus relative to the release body 56) by engaging tab 78 in a selected one of the notches 66 A–D. The possible adjusted positions of the trigger lever 52 relative to the actuator 54 are shown in FIG. 8. Once so engaged, a screw 80 may be inserted into the smooth bore center hole 72 and threadably engaged within center hole 68 to thereby lock the trigger in the desired position.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A bowstring release comprising a release body having a pair of jaws actuated by a trigger, said trigger including a trigger actuator and a trigger lever adapted to seat in any one of plural predetermined positions relative to said trigger actuator to thereby enable adjustment of the trigger relative to the release body.

2. The bowstring release of claim 1 and further comprising a wrist strap connected to said release body.

3. The bowstring release of claim 2 including an elongated, axially adjustable link extending between said release body and said wrist strap.

4. The bowstring release of claim 3 including a connector between said link and said wrist strap.

5. The bowstring release of claim 4 wherein said connector includes a boss having a through bore for receiving a threaded end of said link, and an elongated slot for receiving a portion of said wrist strap.

6. The bowstring release of claim 5 wherein said through bore is tapered.

7. The bowstring release of claim 6 and including a nut for securing said threaded end of said link to said connector.

8. The bowstring release of claim 5 wherein said connector is rotatable substantially 180° relative to said wrist strap.

9. The bowstring release of claim 1 wherein said trigger actuator is formed with an array of recesses and said trigger lever is formed with a tab selectively engageable within one of said recesses.

10. A bowstring release comprising a release body having a pair of jaws actuated by a trigger; and a wrist strap operatively connected to said release body by an elongated link threadably connected at one end to said release body and at an opposite end to said wrist strap, and including a connector between said link and said wrist strap, said connector pivotally mounted to said wrist strap, wherein said connector is substantially triangular in shape with a slot across a base portion thereof and an upstanding boss at an apex portion thereof.

11. The bowstring release of claim 10 wherein said upstanding boss has a through bore for receiving said link.

12. The bowstring release of claim 11 wherein said wrist strap comprises a first underlying strap portion and a second overlying web portion, said overlying web portion passing through said slot in said connector and secured to said underlying strap portion on opposite sides of said connector.

13. The bowstring release of claim 12 wherein said overlying web portion is partially folded over onto itself where it passes through said slot and secured along a line substantially parallel to said slot.

14. The-bowstring release of claim 12 wherein said underlying strap portion is leather and said overlying web portion is nylon.

15. The bowstring release of claim 12 wherein said trigger is adjustable relative to said release body.

16. A bowstring release comprising a release body having a pair of jaws actuated by a trigger, said trigger including a trigger actuator and a trigger lever adapted to seat in any one of plural predetermined positions relative to said trigger actuator to thereby enable adjustment of the trigger relative to the release body; and a wrist strap operatively connected to said release body by an elongated link threadably connected at one end to said release body and at an opposite end to said wrist strap, and including a connector between said link and said wrist strap, said connector pivotally mounted to said wrist strap.

17. A bowstring release comprising a release body assembly having a pair of jaws actuable by a trigger; a first strap adapted for attachment to a user's wrist; and a second strap connecting said release body to said first strap; and means for connecting said first strap to said second strap, said means enabling said release body to pivot toward and away from said first strap, through substantially 180°.

18. The bowstring release of claim 17 wherein said trigger is adjustable relative to said release body assembly.

19. A bowstring release comprising a release body assembly having a pair of jaws actuable by a trigger; a first strap for attachment to a user's wrist; a connector secured to said first strap; an elongated rod secured at one end to said release body and at a second opposite end to said connector; said connector having a tapered smooth bore therein through which said elongated rod extends, thereby permitting limited universal movement of said elongated rod and said release body relative to said connector.

20. The bowstring release of claim 19 wherein one end of said elongated rod is threadably connected to said release body, and further wherein said other end of said elongated rod passes through said tapered smooth bore and is secured by means of a nut.

21. The bowstring release of claim 19 wherein said trigger is adjustable relative to said release body assembly.

22. The bowstring release of claim 20 wherein an effective length of said elongated rod extending between said release body and said first strap is adjustable via rotation of said nut.

23. The bowstring release of claim 19 wherein said connector is secured to said first strap by means of a second strap; said connector having a slot therein through which said second strap passes, thereby enabling said release body to pivot toward and away from said first strap, through substantially 180°.

* * * * *